US006719241B2

(12) United States Patent
Golden

(10) Patent No.: US 6,719,241 B2
(45) Date of Patent: Apr. 13, 2004

(54) CABLE TIE-OFF DEVICE FOR CABLE LIFTS

(76) Inventor: William Golden, 3587 Palmetto Ave., Ft. Myers, FL (US) 33916

( * ) Notice: Subject to any disclaimer, the term of this patent is extended or adjusted under 35 U.S.C. 154(b) by 1 day.

(21) Appl. No.: 10/093,049

(22) Filed: Mar. 7, 2002

(65) Prior Publication Data

US 2003/0168551 A1 Sep. 11, 2003

(51) Int. Cl.[7] ..... B65M 75/28
(52) U.S. Cl. ..... 242/586.1; 242/125.1
(58) Field of Search ..... 242/586.1, 125.1

(56) References Cited

U.S. PATENT DOCUMENTS 866,855 A * 9/1907 Gay ..... 242/164
1,403,021 A * 1/1922 Fogal ..... 242/602.1
1,767,938 A * 6/1930 Monnier et al. ..... 242/586.1
2,358,580 A * 9/1944 Leonard ..... 242/586.1
2,420,594 A * 5/1947 Hall ..... 242/586.1
4,655,922 A * 4/1987 Arai ..... 210/497.1

* cited by examiner

*Primary Examiner*—Kathy Matecki
*Assistant Examiner*—Sang Kim
(74) *Attorney, Agent, or Firm*—Hahn Loeser + Parks; Laura G. Barrow

(57) ABSTRACT

A novel cable-tie off device for cable lifting assemblies (e.g. elevators and boat lifts) is disclosed herein. The device is an elongated member having, in a series, a head portion, a elongated shank portion, and an end portion. Immediately subjacent the head portion is a hole for maintaining the proximal end of a lifting cable therein. The elongated member is designed for engagement within a pair of holes drilled, in registration, through the spool of a winder assembly. When engaged within the spool holes, the elongated member securely maintains the proximal cable end held within the member between the head portion of the member and the outer surface of the spool. A fastener is secured to the end portion of the member to tightly maintain the member within the spool.

18 Claims, 4 Drawing Sheets

CABLE TIE-OFF DEVICE FOR CABLE LIFTS

BACKGROUND AND SUMMARY OF THE INVENTION

Cable lifting devices, such as elevators and powered boat lifts, for example, typically comprise a motor, a winder assembly, and a length of cable attached to the winder assembly at one end of the cable. In the case of boat lifts, one end of the cable 1 is typically secured to the spool 2 by means of a cable clamp 4. The remaining length of cable 1 is transmitted through a pulley system 5 and lifting apparatus (not shown). The cable 1 is first inserted through the end of the drive shaft 2 or spool, as shown in FIG. 1, and then through an exit hole 3 drilled through the shaft. A clamp 4 is secured to the cable 1 as shown and acts as a stop when the cable is drawn tightly (in the direction of the arrows 6), thereby allowing the cable to be wound about the spool. This means of securing a cable to the spool can be time-consuming and labor intensive, however, since the motor often has to be removed prior to installation of the cable.

The present invention is directed to a novel cable-tie off device for use in winder assemblies employing lifting cables, including, but not limited to, winder assemblies used in boat lifts.

DETAILED DESCRIPTION OF THE PREFERRED EMBODIMENTS

Figure 1B:
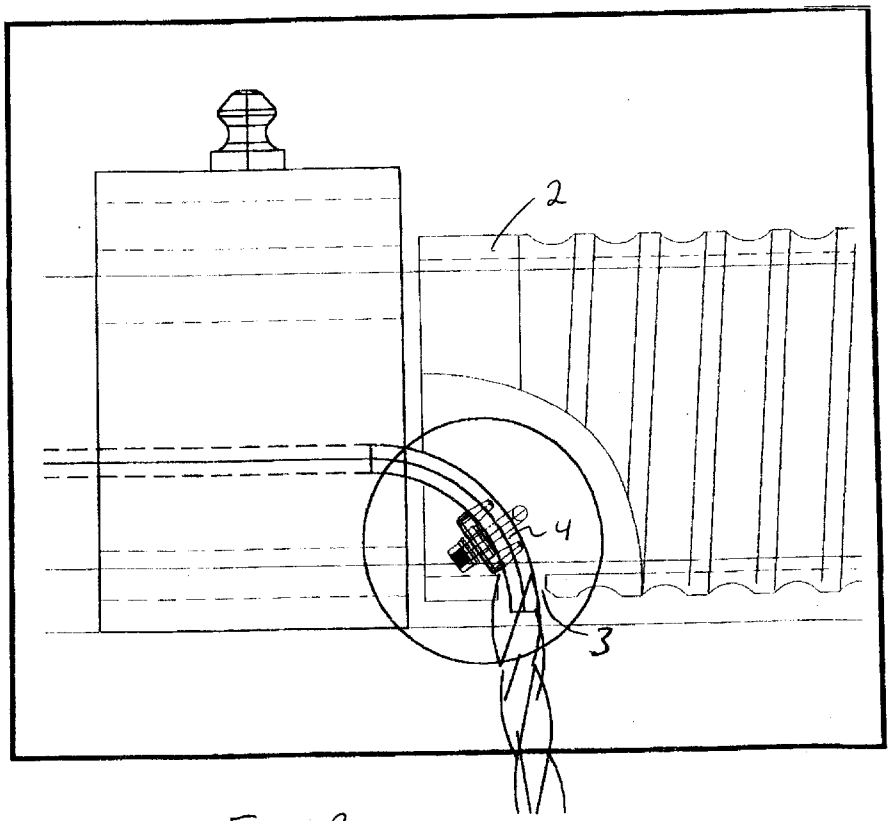
Fig 1B PRIOR ART
FIGS. 1A and 1B illustrate a conventional prior art winder assemblies.
Figure 1A:
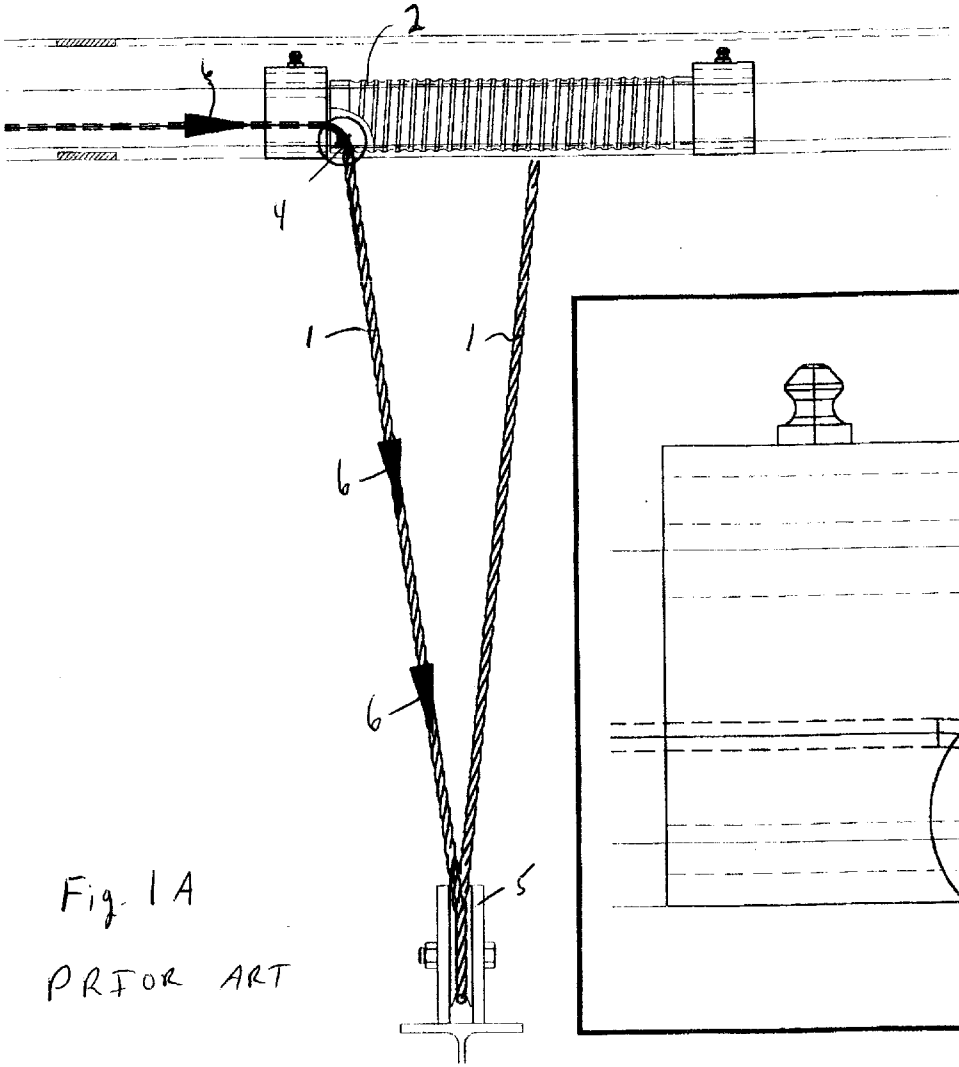
Fig. 1A PRIOR ART
Figure 2B:
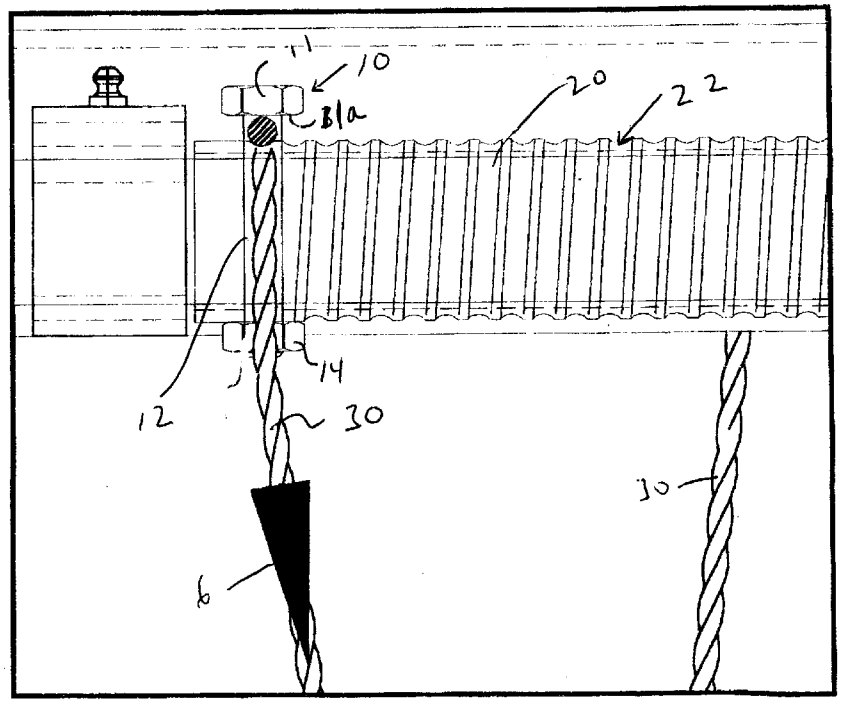
FIG. 2B is an enlarged partial view of the assembly illustrated in FIG. 2A. This figure more clearly shows the cable tie-off device engaged within the spool.
Figure 2A:
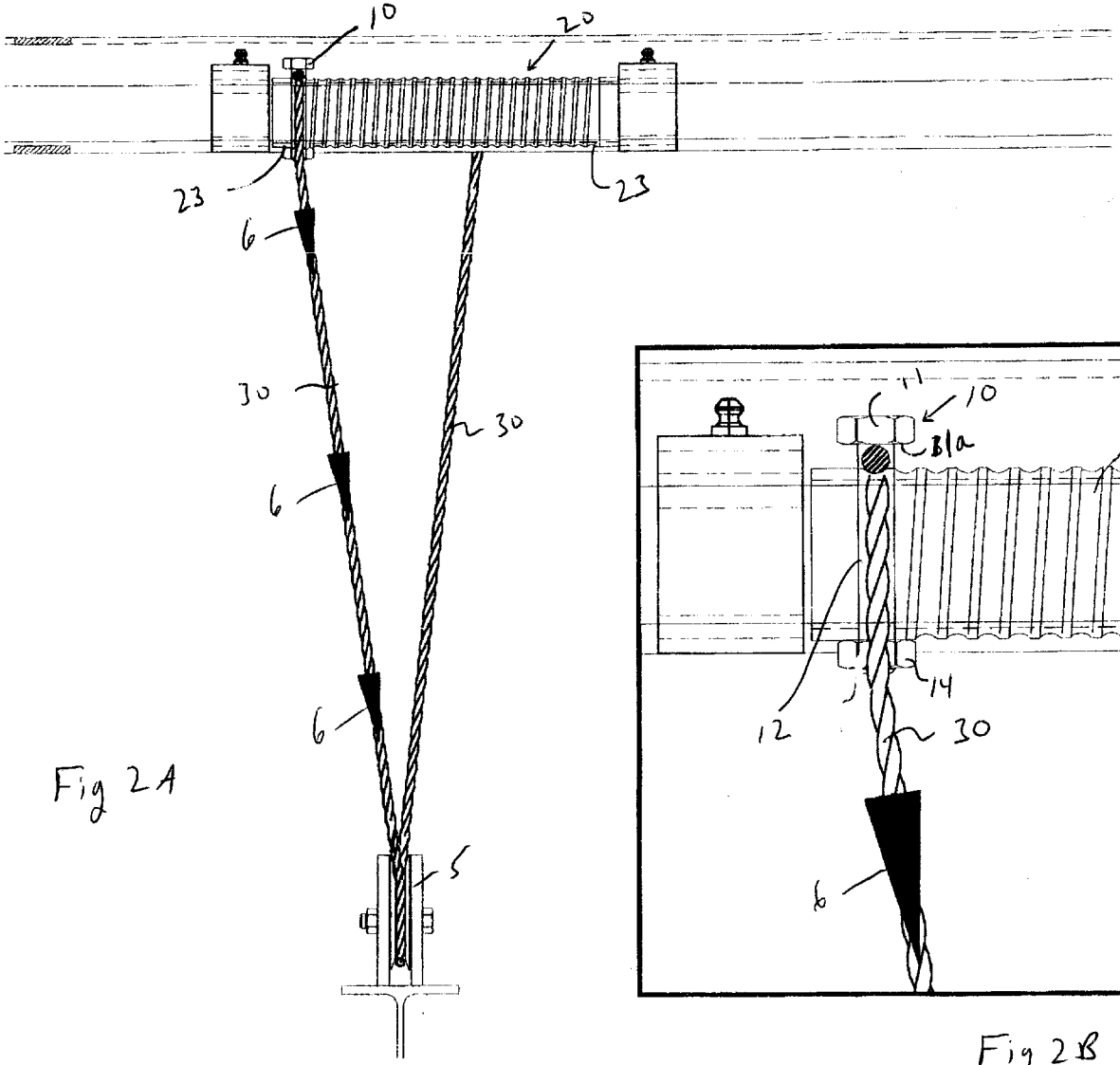
FIG. 2A is a side view of a winder assembly employing the cable tie-off device of the present invention.
Figure 3:
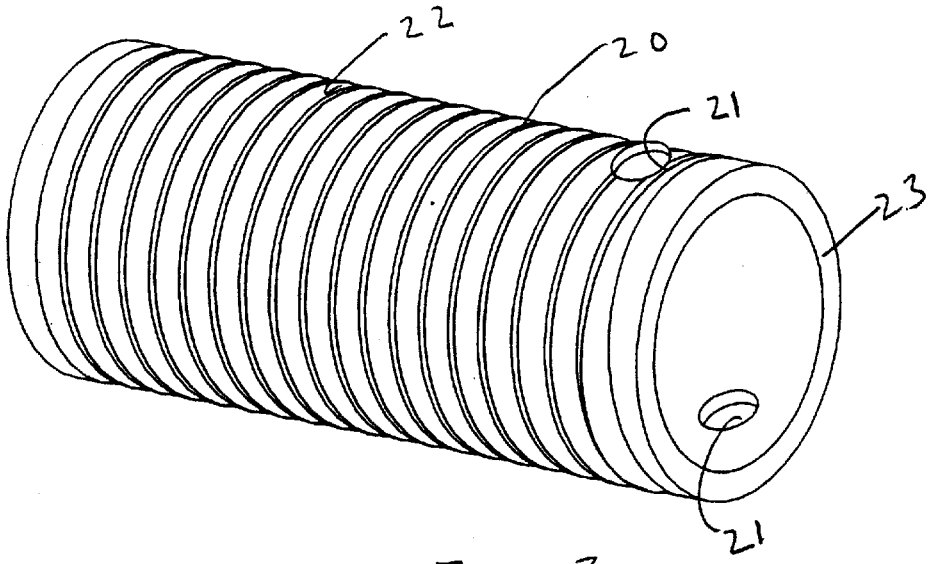
FIG. 3 is a perspective view of a spool for use with the cable tie-off device of the present invention.
Figure 4:
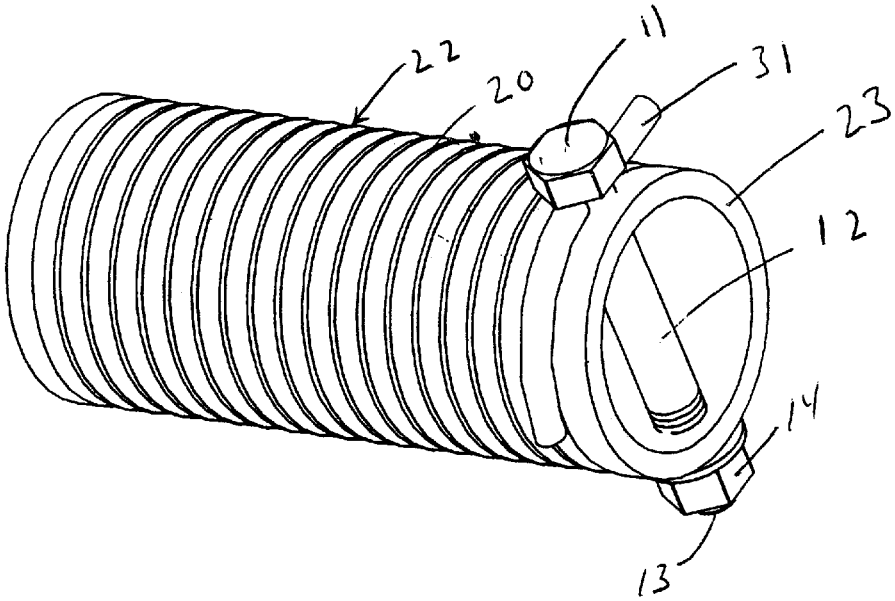
FIG. 4 is a perspective view of a spool, length of cable, and cable tie-off device engaged within the spool.
Figure 7:
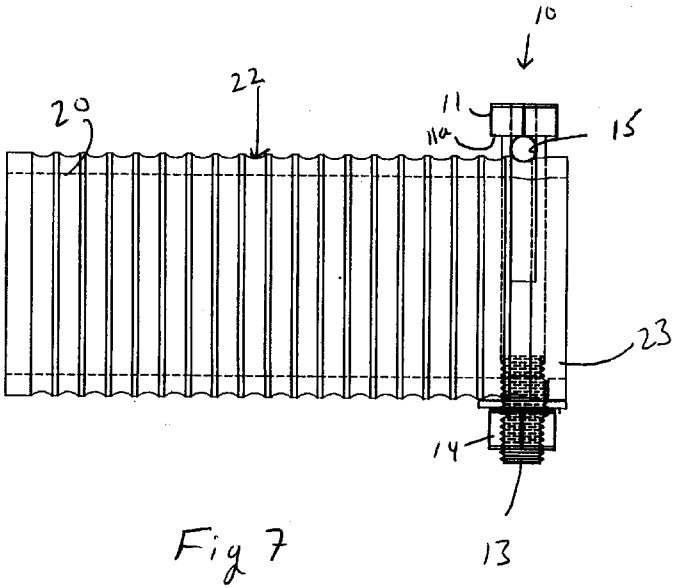
FIG. 7 is a side view of the embodiment shown in FIG. 4.
Figure 5:
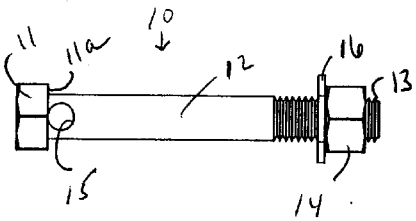
FIG. 5 is a side view of one embodiment of the cable tie-off device.
Figure 6:
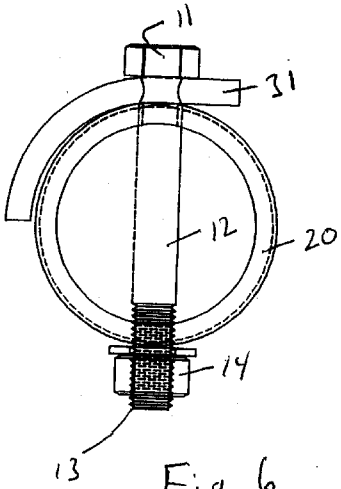
FIG. 6 is an end view of the embodiment shown in FIG. 4.

Referring now to FIGS. 2–7, where similar reference numerals represent similar parts, the present invention, in certain aspects, is directed to a cable tie-off device 10, preferably a bolt, configured to secure one end of a lifting cable directly to the spool 20 of a winder assembly. As used herein, "spool" refers to the rotating elongated shaft or "winder" component of a winder assembly upon which lifting cable is wound. The spool may be a sleeve inserted over a rotatable shaft, or the spool may be in integral, unitary component of the rotatable shaft. The winder assembly is connected to a drive motor (not shown) which, upon activation, powers the winder assembly, thereby rotating the spool to wind and deploy the lifting cable 30. The spool may have a grooved or smooth outer surface 22, as discussed further below.

The cable tie-off device 10 is an elongated member comprising a head portion 11, an elongated shank portion

12, and an end portion 13 for receiving a fastener 14, as discussed in more detail below. Preferably, the elongated member is a solid bolt having a threaded end portion 13 for receiving a complementarily threaded nut 14, as illustrated in the figures; however, it will also be appreciated by those of ordinary skill in the art that the elongated member may also be a round or square pin, rod, bar, or device of similar configuration. Moreover, the elongated member selected may be threaded or unthreaded. For ease of explanation, however, reference is made herein to a bolt.

The bolt includes a hole 15 penetrating transversely through the shank portion 12 of the member immediately subjacent the head portion 11. The hole 15 is of sufficient diameter to receive the proximal end 31 of the lifting cable 30, as shown. The bolt is configured for engagement within a pair of holes 21 drilled through the outer surface 22 of the spool near one of the spool's terminal ends 23. The pair of spool holes 21 are aligned in registration with one another such that the bolt may be inserted therethrough, as shown. To secure the cable to the spool, the proximal end 31 of the cable is inserted through the bolt hole 15. The bolt is then inserted through the pair of spool holes and secured thereto by a fastener 14, preferably a nut, for example, as shown. By subsequently tightening the nut to the bolt, the proximal end 31 of the cable is maintained tightly between the lower surface 11*a* of the bolt head portion 11 and the outer surface 22 of the spool. Upon activation of the winder assembly, the spool rotates, thereby winding and deploying the lifting cable therefrom.

The bolt is preferably fabricated from stainless steel metal, although other conventional materials may be employed if desired, including, but not limited to, forged steel, mild steel, hardened steel, brass, and other types of hard material. When a fully or partially threaded bolt is employed, a complementarily threaded nut (i.e. a hex nut or wing nut) is the preferred fastener 14 for securing the bolt to the spool upon insertion of the bolt through the pair of spool holes 21. If an unthreaded bolt or similar elongated member, such as a rod or pin, for example, is employed, other fasteners, such as a cap or clamp (not shown), may be employed. Preferably an intermediate washer 16 is placed between the fastener 14 and outer surface 22 of the spool to prevent gouging of the spool and to provide optimal fastening.

As discussed above, the outer surface 22 of the spool may be grooved, as shown in the figures, or smooth; however, provision of a grooved outer surface offers the added advantage of minimizing slippage of the cable during lifting operations. In addition, the pair of spool holes 21 are typically round to engage a similarly round bolt, for example; however, the holes 21 may have a square, triangular, or other non-circular configuration, provided the holes 21 have the same configuration as that of the elongated member 10 engaged therein. Finally, the head portion 11 of the bolt must have a larger diameter than its elongated shank portion 12 in order to properly maintain the proximal end 31 of the cable to the spool 20. The head portion 12 may have a hexagonal configuration typical of many bolt heads (as shown), or it may have a different peripheral configuration (e.g. round, square, and the like).

One aspect of the present invention is to provide a winder assembly comprising a spool prefabricated with a pair of holes 21 that are in registration with one another and configured to accommodate the elongated member 12 of the cable tie-off device 10 described and illustrated herein. However, it is also within the scope of the present invention to modify spools of existing winder assemblies used in a variety of cable lift systems to accommodate the inventive cable tie off device, namely by drilling the pair of holes 21 through the spool 20.

The foregoing disclosure and description of the invention are illustrative and explanatory thereof, and various changes in the size, shape, and materials, as well as in the details of the illustrated construction may be made without departing from the spirit of the invention, and therefore fall within the scope of the appended claims even though such variations were not specifically discussed above. For example, the size of the cable tie-off device and diameter of the device hole 15 and spool holes 21 may vary depending upon the size of the spool 20 itself and/or the diameter of the lifting cable 30.

I claim:

1. A cable winder assembly comprising:

a. a rotatable spool having an outer surface configured to wind and deploy a cable secured thereto;

b. said spool further having at one end a pair of holes communicating through said outer surface, and wherein said holes are in registration with one another;

c. a cable tie-off device removably engaged within each of said spool holes, said device comprising, in a series, a head portion, an elongated shank portion, and an end portion, said device further having a hole communicating through said shank portion immediately subjacent said head portion, said device hole configured to receive a proximal end of said cable carried upon said spool such that when said device is engaged within said spool holes and secured therein, said proximal end of said cable is tightly maintained between said head portion and said outer surface of said spool; and d. a means for securing said device to said spool.

2. The assembly of claim 1, wherein said outer surface of said spool has a series of circumferential grooves, each of said grooves configured to maintain said proximal end of said cable therein when said cable is wound thereon.

3. The assembly of claim 1, wherein said device is a bolt having a threaded end portion and wherein said means for securing said bolt to said spool is a complementarily threaded nut fastened to said end portion of said bolt.

4. The assembly of claim 3, wherein said outer surface of said spool has a series of circumferential grooves, each of said grooves configured to hold a length of said cable therein when said cable is wound thereon.

5. The assembly of claim 1, wherein said device is an elongated member selected from the group of bolts, pins, rods, and bars, and wherein said securing means is selected from the group of nuts, caps, and clamps.

6. The assembly of claim 5, wherein said outer surface of said spool has a series of circumferential grooves, each of said grooves configured to maintain said proximal end of said cable therein when said cable is wound thereon.

7. A cable winder assembly comprising:

a. a rotatable spool having an outer surface configured to wind and deploy a cable secured thereto;

b. said spool further having at one end a pair of holes communicating through said outer surface, and wherein said holes are in registration with one another;

c. a cable tie-off device removably engaged within each of said spool holes, said device comprising, in a series, a head portion, an elongated shank portion, and an end portion, said device further having a hole communicating through said shank portion immediately subjacent said head portion, said device hole configured to receive a proximal end of said cable carried upon said spool such that when said device is engaged within said spool holes, said proximal end of said cable is tightly maintained between said head portion and said outer surface of said spool; and d. a fastener secured to said end portion protruding through said spool when said device is engaged therein.

8. The assembly of claim 7, wherein said outer surface of said spool has a series of circumferential grooves, each of said grooves configured to hold said proximal end of said cable therein when said cable is wound thereon.

9. The assembly of claim 7, wherein said device is a bolt having a threaded end portion and wherein said fastener is a complementarily threaded nut.

10. The assembly of claim 9, wherein said outer surface of said spool has a series of circumferential grooves, each of said grooves configured to hold said proximal end of said cable therein when said cable is wound thereon.

11. The assembly of claim 7, wherein said device is an elongated member selected from the group of bolts, pins, rods, and bars, and wherein said securing means is selected from the group of nuts, caps, and clamps.

12. The assembly of claim 11, wherein said outer surface of said spool has a series of circumferential grooves, each of said grooves configured to maintain said proximal end of said cable therein when said cable is wound thereon.

13. A cable winder assembly comprising:

a. a rotatable spool configured to wind and deploy a cable secured thereto, said spool having a sleeve inserted over a rotatable shaft;

b. said spool further having at one end a pair of holes communicating through an outer surface of said sleeve and through said shaft, and wherein said holes are in registration with one another;

c. a cable tie-off device removably engaged within each of said spool holes, said device comprising, in a series, a head portion, an elongated shank portion, and an end portion, said device further having a hole communicating through said shank portion immediately subjacent said head portion, said device hole configured to receive a proximal end of said cable carried upon said spool such that when said device is engaged within said spool holes, said proximal end of said cable is tightly maintained between said head portion and said outer surface of said sleeve; and d. a fastener secured to said end portion protruding through said spool when said device is engaged therein.

14. The assembly of claim 13, wherein said outer surface of said sleeve has a series of circumferential grooves, each of said grooves configured to maintain said proximal end of said cable therein when said cable is wound thereon.

15. The assembly of claim 13, wherein said device is a bolt having a threaded end portion and wherein said means for securing said bolt to said spool is a complementarily threaded nut fastened to said end portion of said bolt.

16. The assembly of claim 15, wherein said outer surface of said sleeve has a series of circumferential grooves, each of said grooves configured to hold a length of said cable therein when said cable is wound thereon.

17. The assembly of claim 13, wherein said device is an elongated member selected from the group of bolts, pins, rods, and bars, and wherein said securing means is selected from the group of nuts, caps, and clamps.

18. The assembly of claim 17, wherein said outer surface of said sleeve has a series of circumferential grooves, each of said grooves configured to maintain said proximal end of said cable therein when said cable is wound thereon.

* * * * *